US006939404B1

(12) United States Patent
Davis et al.

(10) Patent No.: US 6,939,404 B1
(45) Date of Patent: Sep. 6, 2005

(54) LANE MAINTENANCE MACHINE HAVING RECIPROCATING CLEANING LIQUID DISPENSING HEAD

(75) Inventors: John M. Davis, Sebring, FL (US); Mark E. Davis, Sebring, FL (US)

(73) Assignee: Kegel, LLC, Lake Wales, FL (US)

( * ) Notice: Subject to any disclaimer, the term of this patent is extended or adjusted under 35 U.S.C. 154(b) by 0 days.

(21) Appl. No.: 10/818,972

(22) Filed: Apr. 5, 2004

(51) Int. Cl.[7] ..... B05C 1/06
(52) U.S. Cl. ..... 118/207; 118/304; 118/305; 118/323; 15/302; 15/320; 15/4
(58) Field of Search ..... 118/305, 323, 304, 118/207; 15/98, 302, 320, 4, 103.5; 134/6

(56) References Cited

U.S. PATENT DOCUMENTS 5,729,855 A * 3/1998 Davis ..... 15/50.3
6,090,203 A * 7/2000 Gebhardt et al. ..... 118/305
6,298,517 B1 * 10/2001 McKay ..... 15/228
6,615,434 B1 9/2003 Davis et al.

* cited by examiner

*Primary Examiner*—Laura Edwards
(74) *Attorney, Agent, or Firm*—Hovey Williams LLP

(57) ABSTRACT

A lane maintenance machine has a cleaning system that includes at least one cleaning liquid dispensing head which reciprocates back and forth transversely of the lane as the machine travels along the length of the lane. In a preferred embodiment the dispensing head emits successive squirts of liquid from a positive displacement pump, such as a peristaltic pump. The positive displacement pump provides accurate, precise metering of the cleaning liquid and affords board-by-board control of the dispensing action. A wiping assembly immediately behind the cleaning liquid dispensing head provides a web of cloth-like material looped under a compressible backup roller to wipe the applied liquid into a thin film and to pick up a measure of the liquid along with oil and dirt. A vacuum squeegee pickup head trailing the wiping assembly lifts the remaining film of cleaning liquid completely off the lane surface, whereupon lane dressing is applied at the rear of the machine utilizing a dressing dispensing head that, like the cleaning liquid dispensing head, reciprocates transversely of the lane to dispense dressing in a pattern preselected by the operator.

8 Claims, 5 Drawing Sheets

LANE MAINTENANCE MACHINE HAVING RECIPROCATING CLEANING LIQUID DISPENSING HEAD

TECHNICAL FIELD

The present invention relates to bowling lane maintenance machines and, more particularly, to the cleaning mechanism of such machines used to remove dirt, grime and old lane dressing from the surface of the lane before re-applying conditioning dressing thereto.

BACKGROUND AND SUMMARY

Lane maintenance machines that travel up and down the length of a bowling lane removing surface grime and old lane dressing are well known in the art. Some of such machines are combination units which clean the lane in the front half of the machine and apply a fresh film of lane dressing to the lane in the rear half. Other machines are essentially single purpose machines capable of only cleaning the lane or applying the lane dressing. Typically, in machines having a cleaning function, a cleaning liquid is applied and then quickly removed through the use of a vacuum squeegee pickup head and sometimes also a wiping cloth immediately ahead of the squeegee.

Typically, the cleaning liquid is applied using fixed position, pressurized spray nozzles that atomize the liquid and spray it onto the lane surface ahead of the machine. Examples of that type of cleaning system are disclosed in prior U.S. Pat. Nos. 5,729,855 and 6,615,434 owned by the assignee of the present invention. While pressurized, fixed position spray nozzle systems have performed well over the years, they also have certain drawbacks.

For example, the pressurized spray nozzles sometimes drip between spray pulses and at other times, necessitating contrivances to catch and contain such drips. Furthermore, overspray can be a problem wherein the airborne spray droplets are carried by air currents onto adjacent gutters and other structure that must be separately cleaned and maintained from time-to-time. In some establishments having significant air currents, the overspray may even carry into adjacent lanes that have just been cleaned and conditioned.

The present invention provides a solution to problems associated with conventional, fixed position pressurized spray systems. In the present invention, instead of relying only on one or more pressurized nozzles to spray cleaning liquid into the air and allow it to settle onto the lane surface in front of the machine, at least one reciprocating dispensing head is positioned close to the lane surface and travels back and forth across the path of travel of the machine while dispensing a highly controlled volume of cleaning liquid directly onto the surface. The position of the dispensing head as it moves across the width of the lane can be accurately coordinated with the position of the machine along the length of the lane to precisely start and stop liquid flow and produce a predetermined pattern of applied liquid. Board-by-board precision is achievable with this type of system.

Preferably, a positive displacement pump such as a peristaltic pump is utilized to supply cleaning liquid to the dispensing head in successive uniform increments, producing a precisely metered quantity of the liquid. In one form of the invention, the cleaning liquid is not atomized, but rather issues from the dispensing head in a coherent stream to produce a bead of cleaning liquid on the lane surface. In another form of the invention, each increment of liquid is atomized or diffused into small droplets at the point of discharge to cover a larger surface area of the lane.

DETAILED DESCRIPTION

Figure 1:
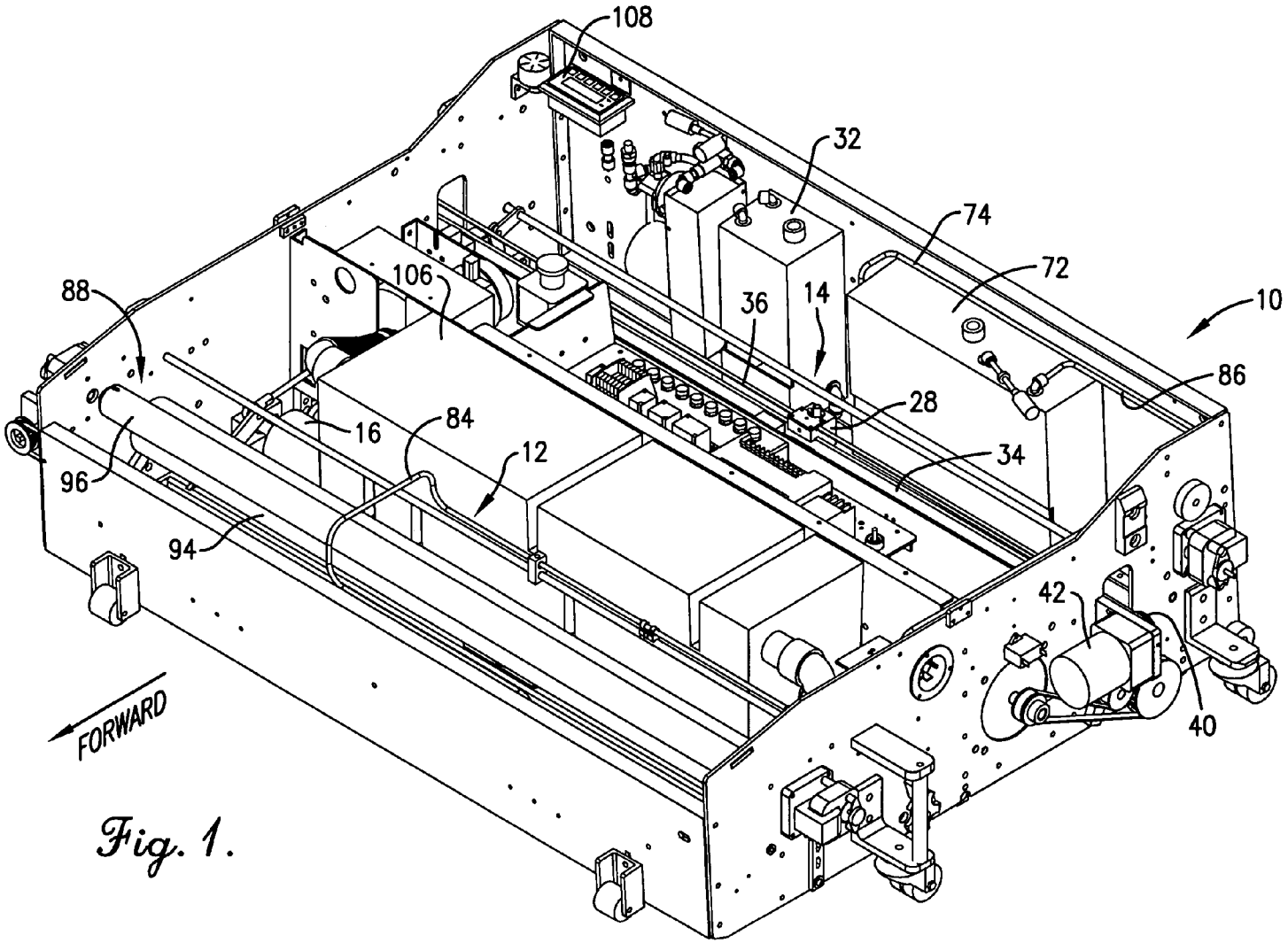
FIG. 1 is a left front perspective view of a maintenance machine embodying the principles of the present invention with its top cover removed to reveal internal details of construction.
Figure 2:
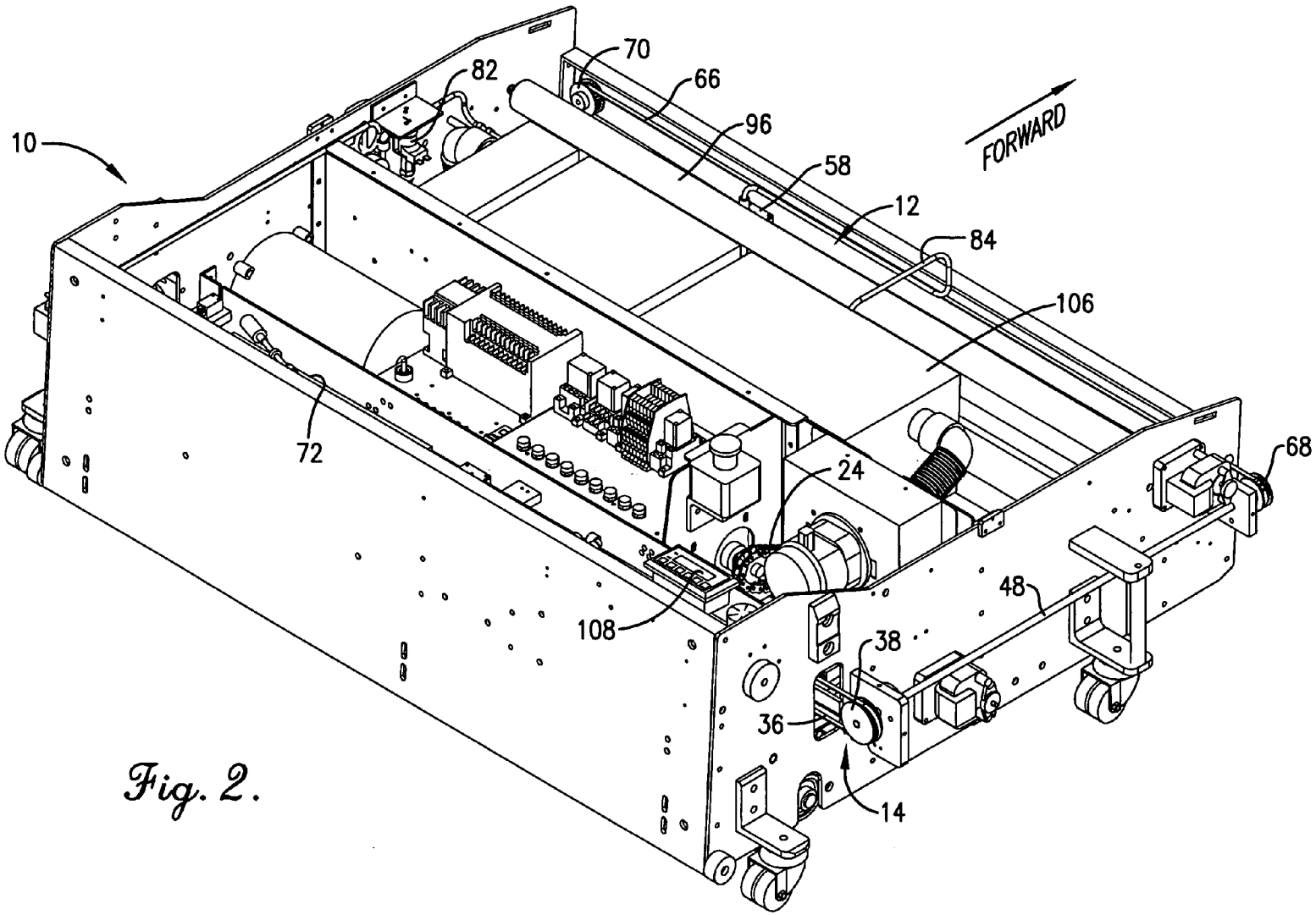
FIG. 2 is a right rear perspective view of the machine.

The present invention is susceptible of embodiment in many different forms. While the drawings illustrate and the specification describes certain preferred embodiments of the invention, it is to be understood that such disclosure is by way of example only. There is no intent to limit the principles of the present invention to the particular disclosed embodiments.

The machine 10 illustrated in the drawings is similar in many respects to the machine disclosed in U.S. Pat. No. 5,729,855. Accordingly, the '855 patent is incorporated herein by reference. In view of the full disclosure in the '855 patent of the construction and operation of the lane machine, the construction and operation of the machine 10 will be described only generally herein.

The machine 10 has a cleaning system denoted broadly by the numeral 12 and located generally in the front of the machine. A dressing application system is denoted broadly by the numeral 14 and located generally in the rear portion of the machine. These two systems perform their functions as the machine travels up and down the lane through the provision of lane-engaging drive wheels 16 and 18 fixed to a transverse shaft 20 that is powered by a drive motor 22 and a chain and sprocket assembly 24.

The dressing application system 14 includes an applicator roll 26 disposed for engaging the lane surface, a reciprocating dressing dispensing head 28 that travels back and forth across the width of the lane above roll 26, and a brush assembly 30 between roll 26 and dispensing head 28 for receiving dressing from head 28 and delivering it to roll 26. Details of the construction and manner of use of brush assembly 30 are disclosed in co-pending application Ser. No. 10/791,413 filed Mar. 2, 2004, and titled "Strip Brush Bowling Lane Dressing Application Mechanism", which is incorporated herein by reference. Dressing application system 14 additionally includes a reservoir 32 and a positive displacement pump (not shown) for supplying dressing from reservoir 32 to dispensing head 28.

Dressing dispensing head 28 is mounted for reciprocation along a transverse guide track 34 extending between the sidewalls of the machine. An endless drive belt 36 is secured to head 28 and has its opposite ends looped around a pair of pulleys 38 and 40, the pulley 40 being operably coupled with a reversible motor 42 to provide driving power to belt 36 and thus propel dispensing head 28 along track 34. A pair of sensors 44 and 46 adjacent opposite ends of the path of reciprocal travel of dispensing head 28 are operable to sense the presence of dispensing head 28 as it reaches one limit of its path of travel so as to signal the motor 42 to reverse directions and drive dispensing head 28 in the opposite direction along track 34.

Figure 3:
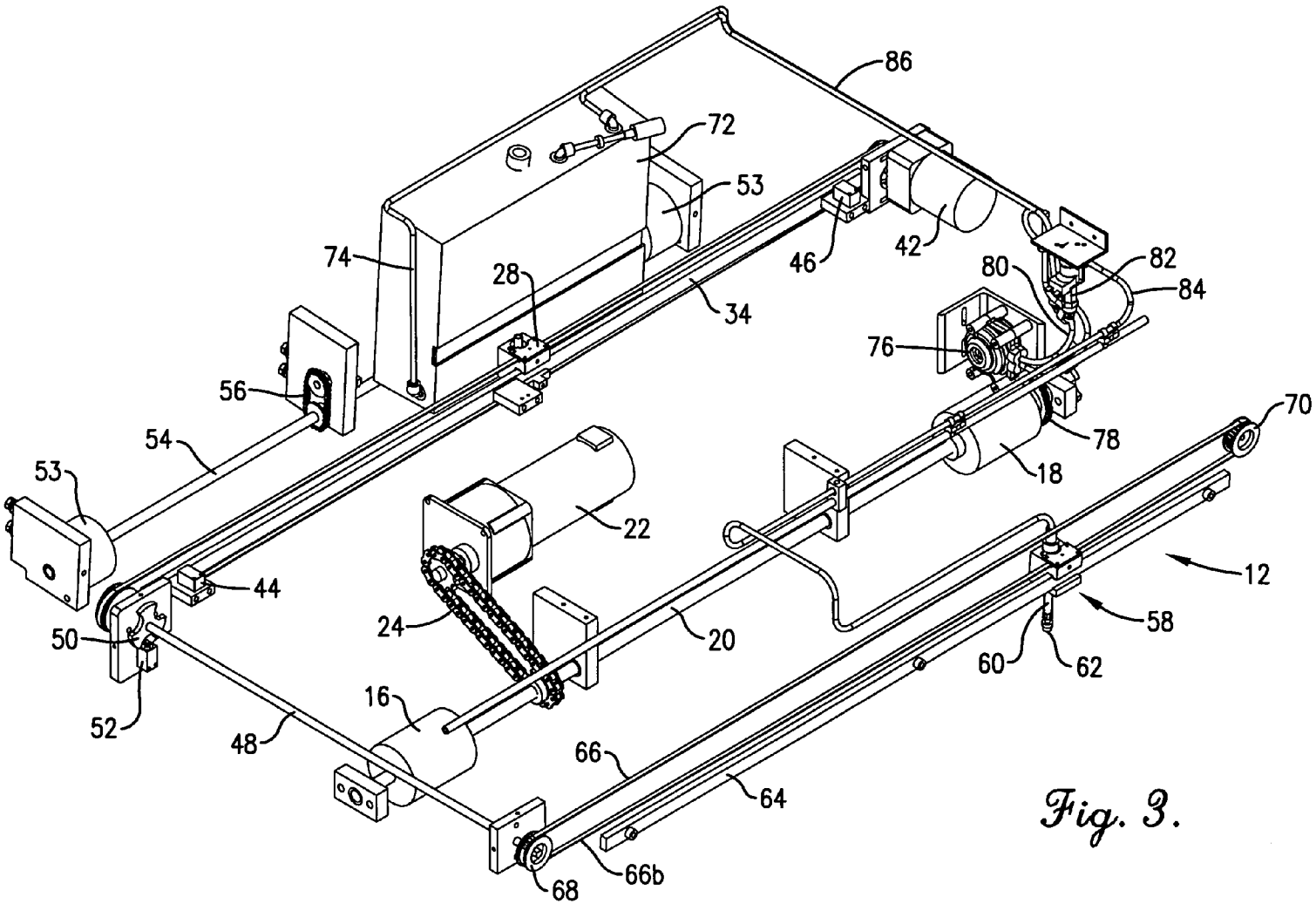
FIG. 3 is a right front perspective illustration of the cleaning system of the machine and its relationship to certain other components.
Figure 4:
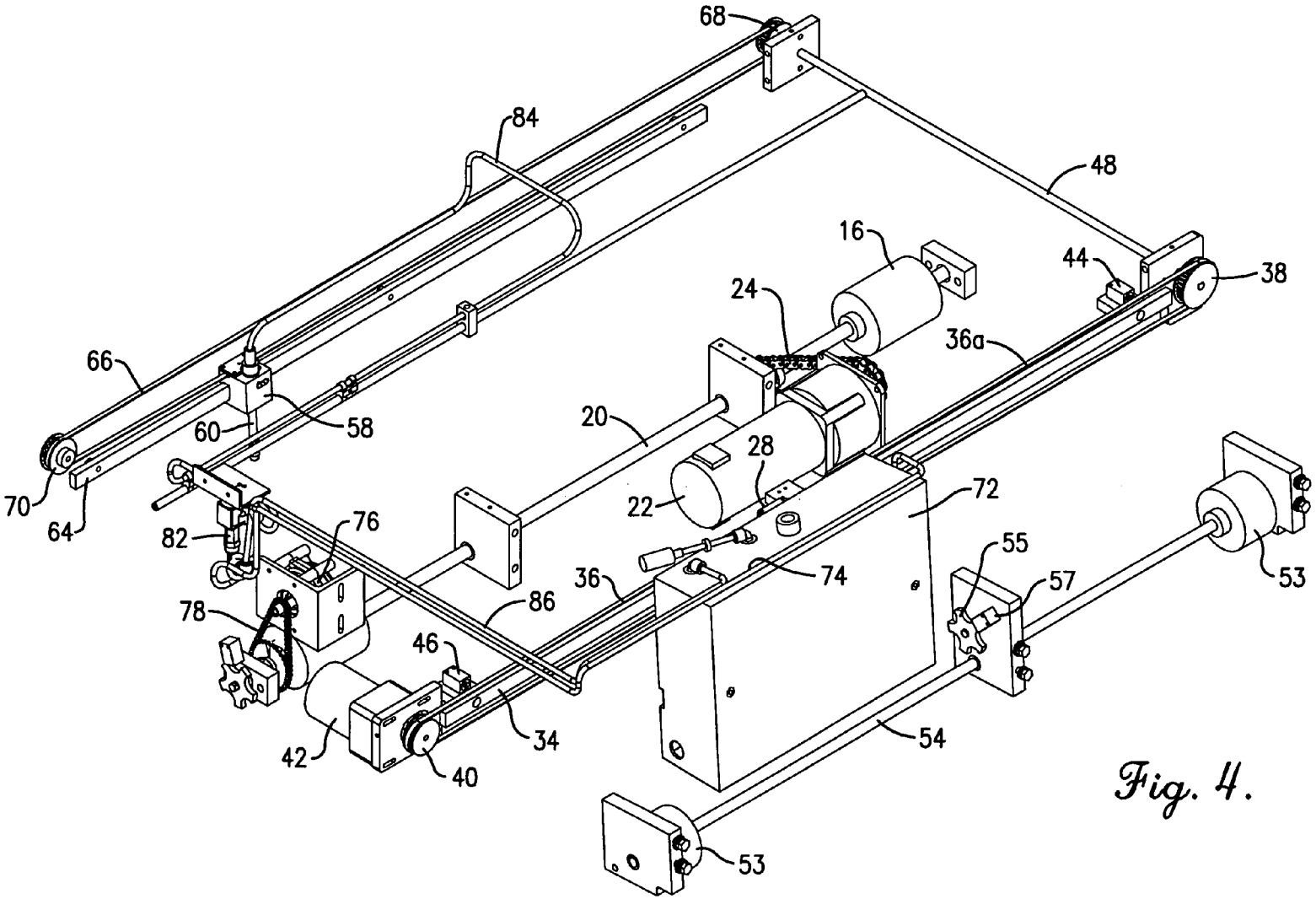
FIG. 4 is a left rear perspective illustration of the cleaning system and related components.
Figure 5:
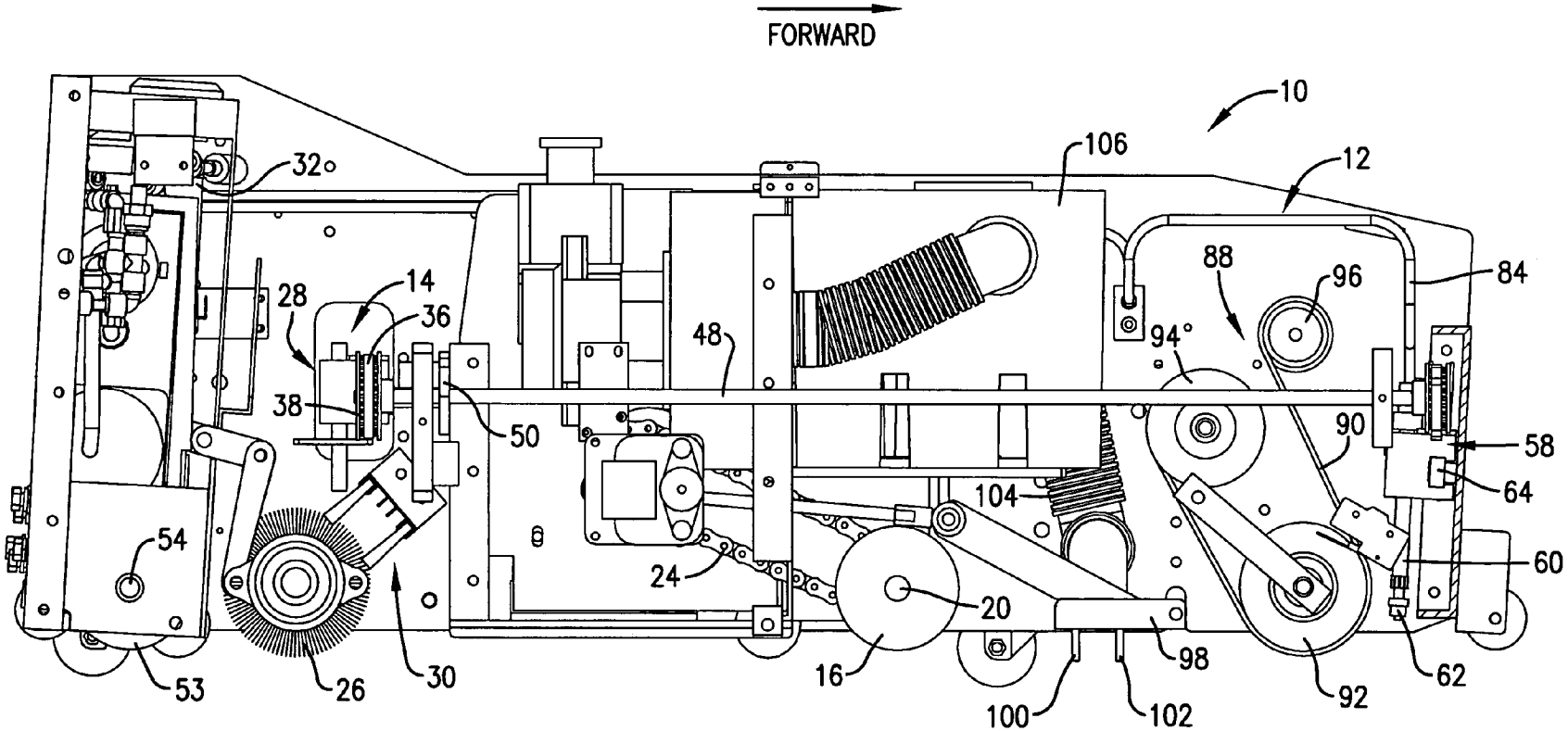
FIG. 5 is a right side elevational view of the machine with the near sidewall thereof removed to reveal internal details of construction.

The pulley 38 is fixed to a long fore-and-aft extending shaft 48 disposed just outboard of the right sidewall of the machine. Near its rear end, just forwardly of pulley 38, shaft 48 is provided with a notched wheel 50 whose rotation is sensed by a sensor 52. An output from sensor 52 may be sent to the control system of the machine (not shown) for the purpose of determining the precise location of the dressing dispensing head 28 across the width of the machine and the bowling lane. Such location is coordinated with a particular lane dressing pattern that has been programmed into the control system of the machine so that dressing dispensing head 28 may be actuated to precisely dispense dressing at predetermined locations along its path of reciprocation. Distance down the lane is determined by a pair of lane-engaging wheels 53 (FIGS. 3, 4 and 5) located just in front of the rear wall of the machine. Wheels 53 are fixed to a common cross shaft 54 that rotates a notched wheel 55 (FIG. 4) via a chain drive 56 (FIG. 3). The number of revolutions of notched wheel 55 is detected by a sensor 57 (FIG. 4) that sends a signal to the control system of the machine.

The cleaning system 12 includes one or more cleaning liquid dispensing heads 58 that reciprocate across the path of travel of the machine as it moves along the lane. While system 12 may also include one or more pressurized spray nozzles as in conventional machines, in a preferred embodiment no such conventional spray nozzles are utilized. In the particular embodiment disclosed herein, only a single dispensing head 58 is utilized, such head 58 traveling essentially the full transverse width of the machine to the same extent as the dressing dispensing head 28.

Dispensing head 58 includes a vertically disposed, depending discharge tube 60 provided with a tip 62 that is located close to the lane surface. In one form of the invention, tip 62 is not in the nature of an atomizing nozzle but is instead configured and arranged to emit liquid in a fairly coherent stream so that a bead of cleaning liquid is laid down on the lane surface. One suitable tip 62 for carrying out this particular non-atomizing function is available from the Value Plastics Company of Fort Collins, Colo. as part number VPS5401001N. Other types of tips (not shown) that atomize, breakup or diffuse liquid supplied to the tip may also be utilized where broader surface area coverage by the cleaning liquid is desired. In either case, tip 62 is preferably provided with an internal check valve (not shown).

Cleaning system 12 further includes a guide track 64 attached to the front wall of machine 10 that slidably supports dispensing head 58 for its reciprocal movement. Track 64 extends across substantially the entire width of machine 10 to the same extent as the track 34 associated with dressing dispensing head 28. An endless drive belt 66 is attached to dispensing head 58 for providing reciprocal drive thereto, the belt 66 at its opposite ends being looped around a pair of pulley wheels 68 and 70 respectively.

Although pulley 68 may be driven in a number of different ways, including by its own separate drive motor, in a preferred form of the invention pulley 68 is fixed to the forward most end of shaft 48 from pulley 38 so that both dispensing heads 28 and 58 are driven by the same reversible motor 42. Consequently, both dressing dispensing head 28 and cleaning liquid dispensing head 58 are reciprocated simultaneously by motor 42 when the latter is actuated. However, it will be noted that dressing dispensing head 28 and cleaning liquid dispensing head 58 reciprocate in mutually opposite directions due to the fact that dressing dispensing head 28 is secured to the upper run 36*a* of its drive belt 36 while cleaning liquid dispensing head 58 is secured to the lower run 66*b* of its drive belt 66.

Cleaning system 12 further includes a cleaning solution reservoir 72 at the rear of machine 10. A supply line 74 leading from reservoir 72 is coupled in flow communication with a peristaltic pump 76 driven by a chain and sprocket assembly 78 operably coupled with the drive shaft 20 of lane drive wheels 16 and 18. When drive wheels 16 and 18 are turning, pump 76 is operating. It will be appreciated, however, that pump 76 could be driven by its own separate drive motor. An outlet line 80 from pump 76 leads to an inlet port of a solenoid-controlled valve 82 whose operation is controlled by the control system of machine 10. A supply line 84 leading from one outlet port of valve 82 communicates the valve 82 with discharge tube 60 of dispensing head 58, while a return line 86 communicates another outlet port of valve 82 with reservoir 72. Thus, depending upon the position of control valve 82, cleaning liquid may either be pumped to dispensing head 58 from reservoir 72 or bypassed back to reservoir 72 via return line 86. Because pump 76 is preferably a peristaltic pump, it supplies liquid to dispensing head 58 in constant volume slugs or squirts that enable the cleaning liquid to be very precisely and accurately metered onto the lane surface. Furthermore, it permits the supply of liquid to dispensing head 58 to be essentially instantaneously stopped and started, which, in conjunction with control valve 82, affords precise, board-by-board control over the pattern of cleaning liquid applied to the lane surface by dispensing head 58.

Cleaning system 12 additionally includes a wiping assembly 88 immediately behind cleaning liquid dispensing head 58. Assembly 88 includes a web 90 of soft material such as duster cloth looped around a lower compressible back-up member 92 in the nature of a roller that extends across the full width of the machine. Cloth 90 is stored on a roll 94 and is paid out at intervals selected by the operator and taken up by a take up roll 96. Wiping assembly 88 is similar in principle to the corresponding wiping assembly disclosed in U.S. Pat. No. 6,615,434, which patent is hereby incorporated by reference into the present specification.

A further component of cleaning system 12 comprises a vacuum pickup head 98 located behind wiping assembly 88. Vacuum pickup head 98 extends essentially the full width of machine 10 and includes a pair of flexible, squeegee-type blades 100 and 102 that assist in picking up the thin film of cleaning liquid left on the lane surface after the wiping assembly 88 has acted upon the liquid. A large vacuum hose 104 leads from pickup head 98 to a holding tank 106 for storing liquid picked up by head 98. Vacuum pressure within holding tank 106 is obtained by means of a suction fan (not shown) coupled with tank 106.

OPERATION

In use, machine 10 is energized and controlled through the use of a user interface panel 108 located adjacent the right rear corner of the machine. Using interface panel 108, any one of a number of different patterns may be selected for applying cleaning liquid to the lane surface and for the application of dressing. Details of the oil pattern application using the dressing dispensing head 28 are described in the incorporated U.S. Pat. No. 5,729,855.

With respect to cleaning operations, as machine 10 travels along the lane surface the cleaning liquid dispensing head 58 reciprocates back and forth along its track 64 across the full width of the lane. Depending upon the distance down the lane as detected by the lane distance sensor 57 and the position of the dispensing head 58 across the width of the lane as detected by the transverse position sensor 52, control valve 82 allows cleaning liquid from constantly operating pump 76 to be squirted onto the lane surface through the outlet tube 60 and tip 62 of dispensing head 58. Although it is contemplated that dispensing head 58 may dispense cleaning liquid to the lane across the full width of the lane, it is also within the scope of the present invention to have cleaning liquid applied on a board-by-board basis for selective stripping or cleaning of the lane surface. The check valve (not shown) within tube 60 or tip 62 instantly closes the discharge path for cleaning liquid from head 58 when control valve 82 is shifted to a non-dispensing position. The check valve thus prevents leakage from dispensing head 58 during periods of non-use and provides a sharp demarcation between the presence and absence of cleaning liquid on the lane surface.

Cleaning liquid deposited by head 58 is immediately wiped into a thin film by cloth 90 looped around the backup roll 92 of wiping mechanism 88. While much of the liquid and oil and dirt are removed by cloth 90, a thin film remains, and this is engaged by the squeegees 100 and 102 of vacuum pickup head 98. Pickup head 98 thus lifts all remaining moisture, oil and grime from the lane surface and deposits it in the holding tank 106. Finally, as the rear of the machine passes over the cleaned region, the lane dressing is applied by applicator roll 26 in the pattern selected by the operator.

The inventor(s) hereby state(s) his/their intent to rely on the Doctrine of Equivalents to determine and assess the reasonably fair scope of his/their invention as pertains to any apparatus not materially departing from but outside the literal scope of the invention as set out in the following claims.

What is claimed is:

1. In a bowling lane maintenance machine wherein cleaning liquid is applied to the surface of the lane as the machine moves along the lane, the improvement comprising:

a cleaning liquid dispensing head reciprocable across the path of travel of the machine and disposed to dispense cleaning liquid directly onto the lane surface during such reciprocation, further comprising a lane dressing dispensing head reciprocable across the path of travel of the machine behind the cleaning liquid dispensing head for use in applying lane dressing to the lane surface.

2. In a bowling lane maintenance machine as claimed in claim 1, said cleaning liquid dispensing head being operable to dispense cleaning liquid at selected locations along its path of reciprocation.

3. In a bowling lane maintenance machine as claimed in claim 2, further comprising a sensor operable to determine the distance the machine has traveled along the length of the lane, said cleaning liquid dispensing head being operably coupled with said sensor in a manner rendering the cleaning liquid dispensing head operable to dispense cleaning liquid in relation to the distance the machine has traveled along the length of the lane.

4. In a bowling lane maintenance machine as claimed in claim 1, said cleaning liquid dispensing head being mounted on a transversely extending track that defines the path of reciprocation of the dispensing head.

5. In a bowling lane maintenance machine as claimed in claim 4, said cleaning liquid dispensing head being operably coupled with a belt and pulley assembly for driving the dispensing head along said track.

6. In a bowling lane maintenance machine as claimed in claim 1, said cleaning liquid dispensing head including a discharge tip for emitting the cleaning liquid in a stream.

7. In a bowling lane maintenance machine as claimed in claim 1, said cleaning liquid dispensing head including a discharge tip operable to emit the cleaning liquid in a spray.

8. In a bowling lane maintenance machine as claimed in claim 1, said cleaning liquid dispensing head and said lane dressing dispensing head being operably coupled with one another in a manner to coordinate movement of the heads, said cleaning liquid dispensing head and said lane dressing dispensing head being operable to dispense their respective cleaning liquid and lane dressing at selectable locations across the width of the lane.

* * * * *